US010748686B2

(12) United States Patent
Fujikawa et al.

(10) Patent No.: US 10,748,686 B2
(45) **Date of Patent: *Aug. 18, 2020**

(54) R-T-B BASED SINTERED MAGNET

(71) Applicant: TDK CORPORATION, Tokyo (JP)

(72) Inventors: Yoshinori Fujikawa, Tokyo (JP); Masashi Miwa, Tokyo (JP)

(73) Assignee: TDK CORPORATION, Tokyo (JP)

( * ) Notice: Subject to any disclaimer, the term of this patent is extended or adjusted under 35 U.S.C. 154(b) by 176 days.

This patent is subject to a terminal disclaimer.

(21) Appl. No.: 15/939,778

(22) Filed: Mar. 29, 2018

(65) Prior Publication Data

US 2018/0286545 A1 Oct. 4, 2018

(30) Foreign Application Priority Data

Mar. 30, 2017 (JP) ..... 2017-069144
Mar. 22, 2018 (JP) ..... 2018-055192

(51) Int. Cl.
*H01F 41/02* (2006.01)
*H01F 1/057* (2006.01)
*C22C 38/00* (2006.01)

(52) U.S. Cl.
CPC ..... *H01F 1/0577* (2013.01); *C22C 38/005* (2013.01); *H01F 41/0293* (2013.01)

(58) Field of Classification Search
None
See application file for complete search history.

(56) References Cited

U.S. PATENT DOCUMENTS

2008/0245442 A1 10/2008 Nakamura et al.
2011/0150691 A1 6/2011 Nakamura et al.
2018/0286545 A1* 10/2018 Fujikawa ..... H01F 1/0577

FOREIGN PATENT DOCUMENTS

JP S59-46008 A 3/1984
JP 2016-154219 A 8/2016
WO 2006/043348 A1 4/2006

OTHER PUBLICATIONS

Li (Japanese Journal of Applied Physics, 2008, vol. 47, No. 10, p. 7876-7878). (Year: 2008).*

* cited by examiner

*Primary Examiner* — Xiaowei Su
(74) *Attorney, Agent, or Firm* — Oliff PLC

(57) ABSTRACT

An R-T-B based sintered magnet including a plural number of main phase particles having an $R_2T_{14}B$ type crystal structure. R is at least one rare earth element essentially including heavy rare earth elements RH, T is at least one transition metal element essentially including Fe or Fe and Co, and B is boron. At least one of the main phase particles is a reverse core-shell main phase particle including a core part and a shell part, in which $C_{RC}/C_{RS}>1.0$ is satisfied when a total RH concentration (at %) in the core part is defined as $C_{RC}$ and a total RH concentration (at %) in the shell part is defined as $C_{RS}$. An existence ratio of the reverse core-shell main phase particles is larger in a surface layer part of the magnet than in a central part of the magnet.

11 Claims, 3 Drawing Sheets

R-T-B BASED SINTERED MAGNET

BACKGROUND OF THE INVENTION

1. Field of the Invention

The present invention relates to an R-T-B based sintered magnet.

2. Description of the Related Art

As disclosed in Patent Document 1, it is known that the R-T-B based sintered magnet has excellent magnetic properties. At present, further improvement of the magnetic properties is desired.

As a method for improving the magnetic properties, particularly coercive force, of the R-T-B based sintered magnet, a method of adding a heavy rare earth element as R (a one-alloy method) when producing the raw material alloy is known. Further, there is a method (a two-alloy method) of pulverizing a main phase alloy not including the heavy rare earth elements and a grain boundary phase alloy including the heavy rare earth elements, then mixing and sintering thereof. Furthermore, as disclosed in Patent Document 2, there is a method (a grain boundary diffusion method) of diffusing the heavy rare earth elements via grain boundaries by adhering the heavy rare earth elements on the surface and heating thereof after producing the R-T-B based sintered magnet.

According to the above one alloy process, a maximum energy product may be lowered in some cases due to the heavy rare earth elements existing in the main phase particle. According to the two-alloy method, it is possible to reduce the heavy rare earth elements in the main phase particle and to suppress a decrease in the maximum energy product. In the grain boundary diffusion method, it is possible to increase the concentration of the heavy rare earth elements only in a region close to the grain boundary among the main phase particles, and to reduce the concentration of the heavy rare earth elements inside the main phase particle. That is, main phase particles having a general core-shell structure can be obtained. A general core-shell structure is a structure in which the concentration of the heavy rare earth elements in the core part is lower than the concentration of the heavy rare earth elements in the shell part covering the core part. This makes it possible to increase coercive force and suppress the lowering of the maximum energy product, as compared with the two-alloy method. Furthermore, the amount of expensive heavy rare earth elements used can be suppressed.

In addition, Patent Document 3 discloses a technique including main phase particles, in which a concentration of the heavy rare earth elements in the core part is higher than the same in the shell part, in order to improve the coercive force as compared with the conventional R-T-B based sintered magnet.

Patent Document 1: JP-S59-46008A

Patent Document 2: International Publication No. 2006/043348

Patent Document 3: JP-2016-154219A

SUMMARY OF THE INVENTION

However, at present, further improvement of coercive force and cost reduction are required.

One of the objects of the present invention is to improve magnetic properties and to obtain a low-cost R-T-B based sintered magnet.

In order to achieve the object, the present invention discloses the following.

An R-T-B based sintered magnet including a plural number of main phase particles having an $R_2T_{14}B$ type crystal structure, in which R is at least one rare earth element essentially including heavy rare earth elements RH, T is at least one transition metal element essentially including Fe or Fe and Co, and B is boron, at least one of the main phase particles is a reverse core-shell main phase particle including a core part and a shell part, in which $C_{RC}/C_{RS}>1.0$ is satisfied when a total RH concentration (at %) in the core part is defined as $C_{RC}$ and a total RH concentration (at %) in the shell part is defined as $C_{RS}$, and an existence ratio of the reverse core-shell main phase particles is larger in a surface layer part of the magnet than in a central part of the magnet.

By having the above properties, the R-T-B based sintered magnet of the invention improves its magnetic properties and becomes a low-cost magnet.

The R-T-B based sintered magnet of the invention may satisfy $C_{RC}/C_{RS}>1.5$.

The R-T-B based sintered magnet of the invention may satisfy the following.

At least one of the main phase particles is a core-shell main phase particle including a core part and a shell part, in which $C_{NC}/C_{NS}<1.0$ is satisfied when a total RH concentration (at %) in the core part is defined as $C_{NC}$ and a total RH concentration (at %) in the shell part is defined as $C_{NS}$.

The R-T-B based sintered magnet of the invention may include a core-shell particle layer mainly including the core-shell main phase particles and a reverse core-shell particle layer mainly including the reverse core-shell main phase particles.

According to the R-T-B based sintered magnet of the invention, the core-shell particle layer and the reverse core-shell particle layer may be arranged in this order from the central part of the magnet toward the surface layer part of the magnet.

The R-T-B based sintered magnet according to the invention may include a non-core-shell particle layer mainly including non-core-shell main phase particles having no core-shell structures, and the non-core-shell particle layer, the core-shell particle layer and the reverse core-shell particle layer may be arranged in this order from the central part of the magnet toward the surface layer part of the magnet.

DESCRIPTION OF THE PREFERRED EMBODIMENTS

Figure 1A:
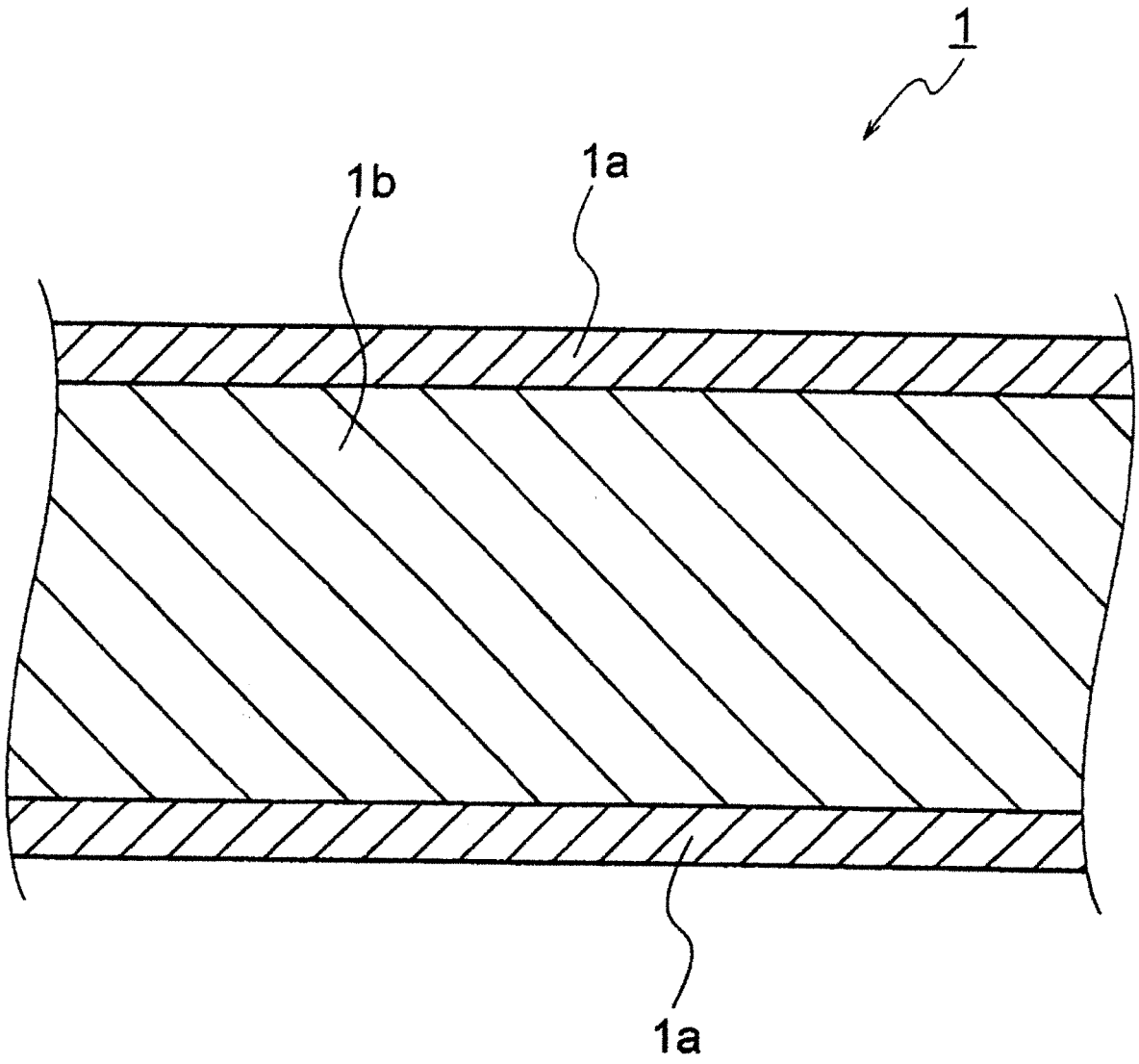
FIG. 1A is a schematic cross-sectional view of an R-T-B based sintered magnet according to an embodiment of the present invention.

Hereinafter, the present invention is described based on the embodiments shown in the Figures.

<R-T-B Based Sintered Magnet>

The R-T-B based sintered magnet 1 according to the present embodiment includes main phase particles including $R_2T_{14}B$ type crystal structures. R is at least one rare earth element essentially including heavy rare earth elements RH, T is at least one transition metal element essentially including Fe or Fe and Co, and B is boron. Further, the R-T-B based sintered magnet 1 may include Zr. The rare earth element included as R refers to Sc, Y and lanthanoid elements belonging to the third group of a long period type periodic table. In addition, the heavy rare earth elements RH are Gd, Tb, Dy, Ho, Er, Tm, Yb and Lu.

An R content is not particularly limited, and it may be 25 mass % or more and 35 mass % or less, and preferably 28 mass % or more and 33 mass % or less. When the R content is 25 mass % or more, the $R_2T_{14}B$ crystal which becomes the main phase particle of the R-T-B based sintered magnet 1 tends to be formed sufficiently, deposition of such as a-Fe having soft magnetism tends to be suppressed, and the deterioration in magnetic properties tends to be suppressed. When the R content is 35 mass % or less, the residual magnetic flux density Br of the R-T-B based sintered magnet 1 tends to be improved.

The B content in the R-T-B based sintered magnet according to the present embodiment may be 0.5 mass % or more and 1.5 mass % or less, preferably 0.8 mass % or more and 1.2 mass % or less, and more preferably 0.8 mass % or more and 1.0 mass % or less. When the B content is 0.5 mass % or more, the coercive force Hcj tends to be improved. Further, when the B content is 1.5 mass % or less, the residual magnetic flux density Br tends to be improved.

T may be Fe alone, or a part of Fe may be substituted with Co. The Fe content in the R-T-B based sintered magnet according to the present embodiment is a substantial balance when unavoidable impurities, O, C and N are removed from the R-T-B based sintered magnet. The Co content is preferably zero mass % or more and 4 mass % or less, more preferably 0.1 mass % or more and 2 mass % or less, and further more preferably 0.3 mass % or more and 1.5 mass % or less. The transition metal elements other than Fe or Fe and Co is not particularly limited, and examples thereof include such as Ti, V, Cr, Mn, Ni, Cu, Zr, Nb, Mo, Hf, Ta and W. In addition, a part of the transition metal element included as T may be substituted with an element such as Al, Ga, Si, Bi and Sn.

When the R-T-B based sintered magnet 1 includes one or two selected from Al and Cu, the content of one or two selected from Al and Cu is preferably 0.02 mass % or more and 0.60 mass % or less each. By respectively including 0.02 mass % or more and 0.60 mass % or less of one or two selected from Al and Cu, the coercive force and moisture resistance of the R-T-B based sintered magnet 1 tends to be improved, and the temperature properties tend to be improved. The Al content is preferably 0.03 mass % or more to 0.4 mass %/o or less, and more preferably 0.05 mass % or more to 0.25 mass % or less. Further, the Cu content is preferably more than zero mass % and 0.30 mass % or less, more preferably more than zero mass % and 0.20 mass % or less, and further preferably 0.03 mass % or more and 0.15 mass % or less.

The R-T-B based sintered magnet 1 may further include Zr. The Zr content may be more than zero mass % and 0.25 mass % or less. By including Zr within the above range, abnormal growth of the main phase particles can be suppressed in producing process of the sintered magnet, mainly in the sintering process. Therefore, the structure of the obtained sintered body (R-T-B based sintered magnet 1) becomes uniform and fine structure, and the magnetic properties of the obtained sintered body tends to be improved. In order to obtain the above effect more satisfactorily, the Zr content may be 0.03 mass % or more and 0.25 mass % or less.

Further, the C content in the R-T-B based sintered magnet 1 is preferably 0.05 mass % or more and 0.30 mass % or less. By setting the C content to 0.05 mass % or more, the coercive force tends to be improved. By setting the C content to 0.30 mass % or less, the coercive force (Hcj) and squareness ratio (Hk/Hcj) tend to be sufficiently high. Hk is the magnetic field strength when the magnetization in the second quadrant of the magnetic hysteresis loop ($4\pi$I-H curve) is 90% of the residual magnetic flux density (Br). The squareness ratio is a parameter indicating the ease of demagnetization due to the action of an external magnetic field and the temperature rise. When the squareness ratio is small, the demagnetization due to the action of the external magnetic field and the temperature increase becomes large. In addition, the strength of the magnetic field required for magnetization increases. In order to obtain more preferred coercive force and squareness ratio, it is preferable to set the C content to 0.10 mass % or more and 0.25 mass % or less.

Further, the O content in the R-T-B based sintered magnet 1 is preferably 0.03 mass % or more and 0.40 mass % or less. By setting the O content to 0.03 mass % or more, corrosion resistance tends to be improved. When the O content is 0.40 mass % or less, the liquid phase tends to be sufficiently formed when sintering, and coercive force tends to be improved. In order to obtain more preferable corrosion resistance and coercive force, the O content may be 0.05 mass % or more and 0.30 mass % or less, and may be 0.05 mass % or more and 0.25 mass % or less.

Further, the N content in the R-T-B based sintered magnet 1 is preferably zero mass % or more and 0.15 mass % or less. When the N content is 0.15 mass % or less, the coercive force tends to be sufficiently improved.

The R-T-B based sintered magnet 1 may include inevitable impurities such as Mn, Ca, Ni, Cl, S, and F in an amount of approximately 0.001 mass % or more and 0.5 mass % or less.

As a method of measuring the amounts of oxygen, carbon, and nitrogen in the R-T-B based sintered magnet, conventionally well-known methods can be used. The oxygen amount is measured by such as an inert gas fusion-non dispersive infrared absorption method, and the carbon amount is measured by such as an in oxygen stream combustion-infrared absorption method, and the nitrogen amount is measured by such as an inert gas fusion-thermal conductivity method.

The grain diameter of the main phase particle including the $R_2T_{14}B$ type crystal structures is not particularly limited, but it is usually 1 μm or more and 10 μm or less.

The type of R is not particularly limited, but preferably includes Nd and Pr. Furthermore, the type of the heavy rare earth elements RH is also not particularly limited, but preferably includes either one or both of Dy and Tb.

Figure 2:
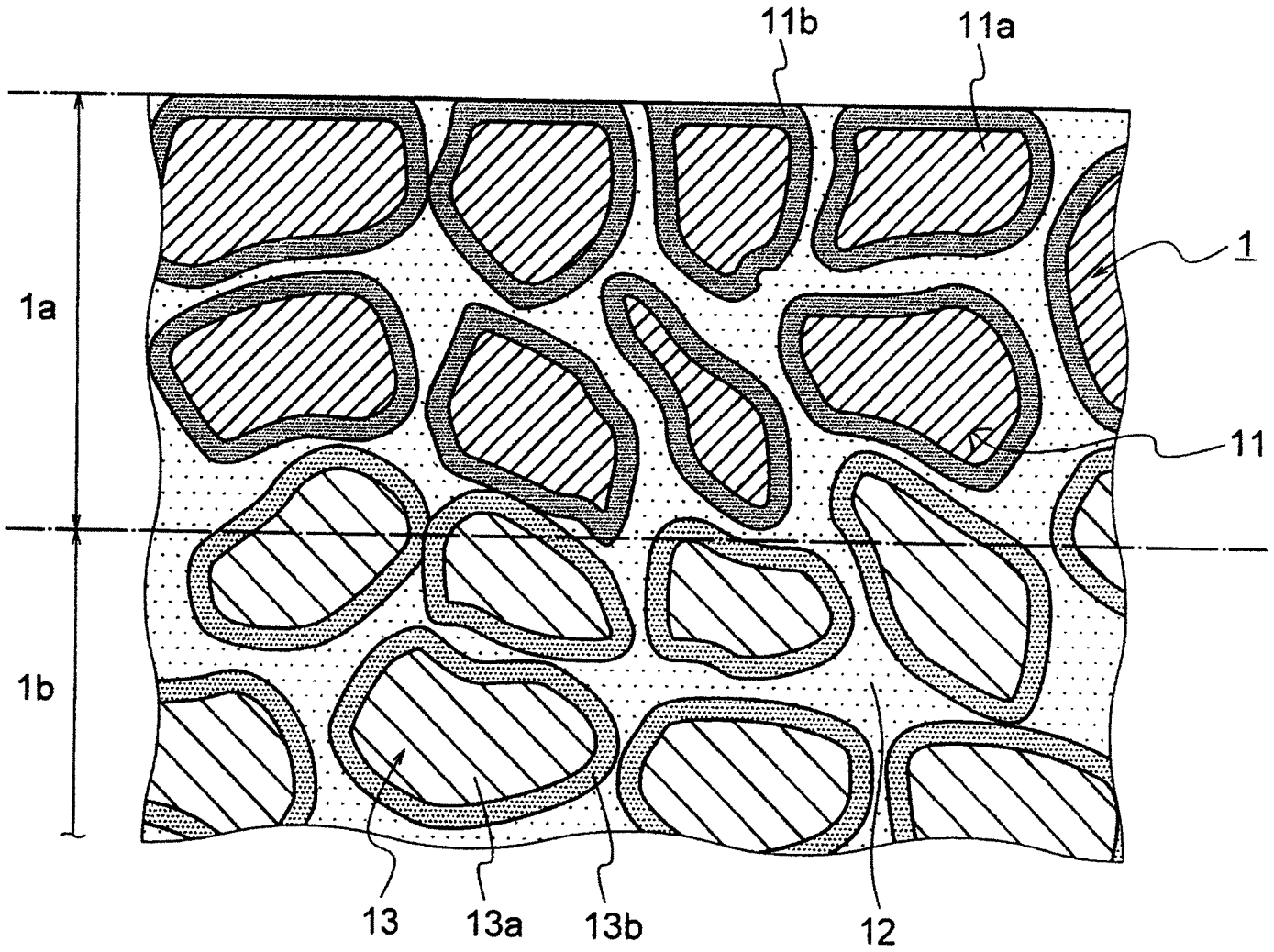
FIG. 2 is a schematic cross-sectional view of the vicinity of a magnet surface layer part of an R-T-B based sintered magnet according to an embodiment of the present invention.

As shown in FIGS. 1A and 2, the R-T-B based sintered magnet 1 according to the present embodiment includes a reverse core-shell particle layer 1*a* mainly including reverse core-shell main phase particles 11 and a core-shell particle layer 1*b* mainly including core-shell main phase particles 13. The reverse core-shell main phase particles 11 and the core-shell main phase particles 13 are main phase particles including the $R_2T_{14}B$ type crystal structures. Further, the grain boundary 12 may exist between the main phase particles.

As shown in FIG. 2, the reverse core-shell main phase particles 11 include a core part 11*a* and a shell part 11*b* covering the core part 11*a*. In addition, the core-shell main phase particles 13 include a core part 13*a* and a shell part 13*b* covering the core part 13*a*. Each main phase particle is a core-shell structured particle, that is, the reverse core-shell main phase particle 11 or the core-shell main phase particle 13, which can be confirmed by observing with SEM at a magnification of 1,000 or more to 10,000 or less times.

Specifically, the section obtained by cutting the R-T-B based sintered magnet 1 of the present embodiment is mirror polished and then a backscattered electron image is taken by SEM. It is possible to discriminate from the composition contrast generated in the backscattered electron image whether each main phase particle is the core-shell main phase particle 13 or the reverse core-shell main phase particle 11. Generally, the composition contrast becomes brighter (whiter) as the average atomic number of the observation target increases. In addition, the heavy rare earth elements RH has a larger atomic number as compared with other elements included in the R-T-B based sintered magnet 1. Therefore, in the region where the concentration of heavy rare earth elements RH is relatively high, the average atomic number becomes larger as compared with the region where the concentration of heavy rare earth elements RH is relatively low. In the backscattered electron image, a region with a high RH concentration inside the main phase particle is brighter (whiter) than a region with a low RH concentration. From the above, it can be determined whether each main phase particle is the core-shell main phase particle 13 or the reverse core-shell main phase particle 11 depending on the position of the bright part inside the main phase particle.

Here, the reverse core-shell main phase particles 11 are the main phase particles including the $R_2T_{14}B$ type crystal structures. The reverse core-shell main phase particles 11 satisfies $C_{RC}/C_{RS}>1.0$, when a total RH concentration (at %) in the core part 11*a* is $C_{RC}$, a total RH concentration (at %) in the shell part 11*b* is $C_{RS}$.

That is, the reverse core-shell main phase particles 11 are the main phase particles in which the total RH concentration in the core part 11*a* is higher than that in the shell part 11*b*, contrary to the generally known core-shell main phase particles.

There are no particular limitations on a measurement place of $C_{RC}$ and $C_{RS}$. For example, it can be as follows.

First, the reverse core-shell main phase particles 11 for measuring the concentration is observed with transmission electron microscope (TEM), and a diameter having a maximum length is specified. Next, two intersection points of the diameter and the grain boundary are specified. Then, the total RH concentration in a region of 20 nm×20 nm centered on a midpoint of the two intersection points can be measured, and defined as the total RH concentration $C_{RC}$ in the core part.

Next, one of the two intersection points is selected. Then, the total RH concentration in a region of 20 nm×20 nm centered at the point, penetrating the reverse core-shell main phase particle side and 20 nm apart from the intersection point along the diameter having the maximum length can be measured, and defined as the total RH concentration $C_{RS}$ in the shell part.

On the other hand, the core-shell main phase particles 13 are main phase particles including the $R_2T_{14}B$ type crystal structures. The core-shell main phase particles 13 satisfy $C_{NC}/C_{NS}<1.0$, when a total RH concentration (at %) in the core part 13*a* is $C_{NC}$, a total RH concentration (at %) in the shell part 13*b* is $C_{NS}$.

That is, the core-shell main phase particles 13 are the main phase particles in which the total RH concentration in the core part 13*a* is lower than that in the shell part 13*b*, as is generally known core-shell main phase particles.

There are no particular limitations on a measurement place of $C_{NC}$ and $C_{NS}$. For instance, the measurement place can be set similarly to $C_{RC}$ and $C_{RS}$.

The total RH concentration with respect to the total R concentration in the core part 11*a* of the reverse core-shell main phase particles 11 is not particularly limited, but is generally about 30% or more and 80% or less in an atomic ratio. The total RH concentration with respect to the total R concentration in the shell part 11*b* of the reverse core-shell main phase particles 11 is not particularly limited, but is generally about 10% or more and 30% or less in the atomic ratio.

The total RH concentration with respect to the total R concentration in the core part 13*a* of the core-shell main phase particles 13 is not particularly limited, but is generally about zero % or more and 10% or less in an atomic ratio. The total RH concentration with respect to the total R concentration in the shell part 13*b* of the core-shell main phase particles 13 is not particularly limited, but is generally about 10% or more and 30% or less in the atomic ratio.

As a result, the core part 11*a* of the reverse core-shell main phase particles 11 usually has the highest total RH concentration relative to the total R concentration, and the core part 13*a* of the core-shell main phase particles 13 has the lowest total RH concentration relative to the total R concentration. The total RH concentration with respect to the total R concentration does not change significantly in the shell part 11*b* of the reverse core-shell main phase particles 11 and in the shell part 13*b* of the core-shell main phase particles 13.

In FIG. 2, although the shell part 11*b* covers the entire surface of the core part 111*a* in the reverse core-shell main phase particle 11, it is not necessary for the shell part 11*b* to cover the entire surface of the core part 11*a*. It is sufficient that the shell part 11*b* covers 60% or more of the surface of the core part 11*a*. The core part 11*a* and the shell part 11*b* can be distinguished by SEM. The same applies to the core-shell main phase particles 13.

The R-T-B based sintered magnet 1 according to the present embodiment includes the reverse core-shell main phase particles 11. Therefore, the magnet 1 becomes a permanent magnet having high magnetic properties, even when the usage amount of the heavy rare earth elements is reduced. The mechanism by which the above-described effect is obtained by including the reverse core-shell main phase particles 11 is thought to be the mechanism described below.

The reverse core-shell main phase particles 11 include more RH as compared with the shell part 11*b*, thereby increasing the anisotropic magnetic field in the core part 11*a*. Therefore, it is considered that the anisotropic magnetic field changes at the interface between the core part 11*a* and the shell part 11*b* of the reverse core-shell main phase particles 11. It is considered that the pinning force increases due to the change in the anisotropic magnetic field in the reverse core-shell main phase particles 11. Therefore, it is considered that the R-T-B based sintered magnet 1 including the reverse core-shell main phase particles 11 improves coercive force.

Further, as shown in FIGS. 1A and 2, existence ratio of the reverse core-shell main phase particles 11 with respect to all the main phase particles is higher in the magnet surface layer part than in the magnet central part. It is preferable that the reverse core-shell particle layer 1*a* mainly including the reverse core-shell main phase particles 11 is present in the magnet surface layer part.

The reverse core-shell main phase particles 11 include more of the heavy rare earth elements RH in the core part 11*a*. Therefore, the residual magnetic flux density and saturation magnetization of the reverse core-shell main phase particles 11 are low. Since the reverse core-shell main phase particles 11 have low saturation magnetization, even if a certain reverse core-shell main phase particle 11 undergoes a magnetization reversal, the influence on the magnetization reversal of the main phase particle adjacent to the reverse core-shell main phase particles 11 is small. That is, since the reverse core-shell particle layer 1*a* mainly including the reverse core-shell main phase particles 11 is present in the magnet surface layer part of the R-T-B based sintered magnet 1, transfer of the reverse magnetic domain generated from the magnet surface is suppressed. Therefore, since the reverse core-shell main phase particles 11 exist more in the magnet surface layer part and the reverse core-shell particle layer 1*a* exists in the magnet surface layer part, the coercive force of the R-T-B based sintered magnet 1 is further improved.

The reverse core-shell main phase particles 11 included in the R-T-B based sintered magnet 1 according to the present embodiment is preferable to satisfy $C_{RC}/C_{RS}>1.5$, and is more preferable to satisfy $C_{RC}/C_{RS}>3.0$. In the reverse core-shell main phase particles 11, when the heavy rare earth elements RH are more present in the core part 11*a* than in the shell part 11*b*, the above-mentioned effect becomes greater and the coercive force is further improved, which is preferable.

In the present embodiment, the magnet surface layer part is a region of 5 μm or more and 150 μm or less from a surface of the magnet toward an inside of the magnet. The magnet central part is a part inside the magnet surface layer part. Further, the reverse core-shell particle layer 1*a* is not necessarily present in all magnet surface layer parts of the R-T-B based sintered magnet 1, but may exist only in a part of the magnet surface layer part. As shown in FIG. 2, the reverse core-shell particle layer 1*a* is a layer in which the reverse core-shell main phase particles 11 are present. In addition, the core-shell particle layer 1*b* is a layer in which the core-shell main phase particles 13 exist and the reverse core-shell main phase particles 11 do not exist.

The thickness of the reverse core-shell particle layer 1*a* is not particularly limited. It is preferably 10 μm or more and 100 μm or less.

In the R-T-B based sintered magnet according to the present embodiment, as shown in FIG. 1A, the core-shell particle layer 1*b* and the reverse core-shell particle layer 1*a* are arranged in this order from the magnet central part toward the magnet surface layer part. Further, the R-T-B based sintered magnet may only include the reverse core-shell particle layer 1*a* and the core-shell particle layer 1*b*.

<Producing Method of R-T-B Based Sintered Magnet>

Next, a producing method of the R-T-B based sintered magnet according to the present embodiment will be described.

Hereinafter, the R-T-B based sintered magnet, produced by a powder metallurgy method in which the heavy rare earth elements are diffused at the grain boundary, will be described as an example, however, the producing method of the R-T-B based sintered magnet according to the present embodiment is not particularly limited, and other methods can also be used.

The producing method of the R-T-B based sintered magnet according to the present embodiment includes a pressing step of pressing a raw material powder to obtain a green compact, a sintering step of sintering the green compact to obtain a sintered body, and an aging step of maintaining the sintered body at a temperature lower than the sintering temperature for a certain period of time.

Hereinafter, the producing method of the R-T-B based sintered magnet will be described in detail, however as a matter not specified, a known method can be used.

[Preparing Step of Raw Material Powder]

The raw material powder can be prepared by a known method. In the present embodiment, the R-T-B based sintered magnet is produced by the single alloy method using one of the raw material alloy mainly including the $R_2T_{14}B$ phase, however, it may be produced by the two-alloy method using two of raw material alloys. Here, the composition of the raw material alloy is controlled so as to be the composition of the finally obtained R-T-B based sintered magnet.

First, a raw material metal corresponding to the composition of the raw material alloy of the present embodiment is prepared, and a raw material alloy of this embodiment is produced from the raw material metal. There is no particular limitation on the producing method of the raw material alloy. For example, the raw material alloy can be produced by a strip casting method.

After producing the raw material alloy, the produced raw material alloy is pulverized (a pulverization step). The pulverization step may be carried out in two stages or in one stage. The pulverization method is not particularly limited. For example, it is carried out by a method using various pulverizers. For example, the pulverization step can be carried out in two stages, a coarse pulverization step and a fine pulverization step, and in the coarse pulverization step, such as a hydrogen pulverization can be carried out. Specifically, it is possible to carry out dehydrogenation at 400° C. or more and 650° C. or less for 0.5 hour or more to two hours or less in an Ar gas atmosphere, after the raw material alloy stores hydrogen at room temperature. Further, the fine pulverization step can be carried out by using a jet mill, a wet attritor, etc., after adding such as oleic acid amide, zinc stearate, etc. to the powder after the coarse pulverization. There is no particular limitation on the grain diameter of the fine pulverized powder (the raw material powder) to be obtained. For example, it can be finely pulverized so as to be finely pulverized powder (raw material powder) having a grain diameter (D50) of 1 μm or more and 10 μm or less.

[Pressing Process]

In the pressing step, the finely pulverized powder (the raw material powder) obtained by the pulverization step is pressed into a predetermined shape. The pressing method is not particularly limited, but in the present embodiment, the finely pulverized powder (the raw material powder) is filled in a metal mold and pressurized in a magnetic field.

It is preferable to perform pressurization when pressing at 30 MPa or more and 300 MPa or less. The applied magnetic field is preferably 950 kA/m or more and 1600 kA/m or less. The shape of the green compact obtained by pressing the finely pulverized powder (the raw material powder) is not particularly limited, and it can have an arbitrary shape depending on the shape of a desired R-T-B based sintered magnet, such as a rectangular parallelepiped, a flat plate, a column, etc.

[Sintering Step]

Sintering step is a step of sintering the green compact in a vacuum or an inert gas atmosphere to obtain a sintered body. The sintering temperature needs to be adjusted according to various conditions such as composition, pulverization method, difference in grain size and grain size distribution, etc. However, it is sintered by firing at the sintering temperature of 1000° C. or more and 1200° C. or less in a vacuum or in the presence of an inert gas for one hour or more and 10 hours or less. As a result, a high dense sintered body (sintered magnet) can be obtained.

[Aging Step]

The aging step is performed by heating the sintered body (a sintered magnet) after the sintering step at a temperature lower than the firing temperature. There is no particular limitation on temperature and time of the aging, but it can be carried out, for example, at 450° C. or more and 900° C. or less for 0.2 hour or more and three hours or less. This aging step may be omitted.

Further, the aging step may be carried out in one stage or in two stages. In the case of carrying out in the two stages, for example, the first stage can be set to 700° C. or more and 900° C. or less for 0.2 hour or more and three hours or less, and the second stage can be set to 450° C. or more and 700° C. or less for 0.2 hour or more and three hours or less. Further, the first stage and the second stage may be carried out continuously, or the second stage may be carried out after once cooling to near room temperature and reheating after the first stage.

[Reverse Core-Shell Main Phase Particle Generation Step]

There is no particular limitation on a generation method of the reverse core-shell main phase particles in the present embodiment. For example, the reverse core-shell main phase particles can be obtained through the following decomposition step, grain boundary diffusion step and recrystallization step.

[Decomposition Step]

The decomposition step is a step of decomposing and disproportionating the main phase particles including the $R_2T_{14}B$ type crystal structure mainly existing in the magnet surface layer part. The conditions of the decomposition step are not particularly limited as long as the main phase particles, including the $R_2T_{14}B$ type crystal structure and mainly existing in the magnet surface layer part, can be decomposed.

For example, by heating in an inert atmosphere including $H_2$ gas, CO gas or $N_2$ gas, at about 600° C. or more and 900° C. or less, for approximately 5 minutes or more to 60 minutes or less, $H_2$, CO or $N_2$ is stored to the main phase particles mainly existing in the magnet surface layer part are subjected to decomposition and disproportionation.

By controlling the concentration of $H_2$ gas, CO gas or $N_2$ gas, heating temperature and/or heating time, the thickness of the region where the main phase particles disproportionate can be controlled and the thickness of the finally obtained reverse core-shell particle layer can also be controlled.

It is also possible to decompose and disproportionate the main phase particles existing in the magnet surface layer part by heating in an oxidizing atmosphere including an oxidizing gas at about 300° C. or more to 500° C. or less for about 20 minutes or more to 60 minutes or less.

[Diffusion Step]

In the present embodiment, the decomposition step is followed by a diffusion step in which the heavy rare earth elements are further diffused. The diffusion can be carried out by adhering such as compounds including the heavy rare earth elements to a surface of the sintered body subjected to the decomposition step, and then subjecting it to heat treatment. The adhering method of the compounds including the heavy rare earth elements is not particularly limited, and it can be adhered by such as applying slurry including the heavy rare earth elements. In this case, the above $C_{RC}/C_{RS}$ can be controlled by controlling the coating amount of the slurry and the concentration of the heavy rare earth elements included in the slurry.

However, the adhering method of the heavy rare earth element is not particularly limited. For example, there are methods using vapor deposition, sputtering, electrodeposition, spray coating, brush coating, jet dispenser, nozzle, screen printing, squeegee printing, sheet construction method, etc.

The heavy rare earth included compound is preferably in the form of grains. Further, the average grain diameter is preferably 100 nm or more and 50 μm or less, and more preferably 1 μm or more and 10 μm or less.

As the solvent used for the slurry, it is preferable to use a solvent capable of uniformly dispersing the heavy rare earth included compound without dissolving the compound. For example, alcohols, aldehydes, ketones, etc. can be exemplified, and among them, ethanol is preferable.

The content of the heavy rare earth included compound in the slurry is not particularly limited. For example, it may be 50 wt % or more and 90 wt % or less. If necessary, the slurry may further include components other than the heavy rare earth included compound. For example, dispersants for preventing aggregation of particles of the heavy rare earth included compound can be mentioned.

By performing the diffusion step on the sintered body subjected to the decomposition step, in the region where the main phase particles present in the magnet surface layer part are decomposed and disproportionated, in addition to the grain boundaries of the entire sintered body, with the decrease of the melting point, a liquid phase is formed and the heavy rare earth elements RH diffuse into the liquid phase. Since $R_2T_{14}B$ crystals including the heavy rare earth elements RH as R is more likely to be generated when compared to the $R_2T_{14}B$ crystal not including the heavy rare earth elements RH as R. Thus, a liquid phase including diffused heavy rare earth elements partially crystallizes, and becomes the core part of the finally obtained the reverse core-shell main phase particles.

Conditions of the diffusion step is not particularly limited, however it is preferable to perform at 650° C. or more and 1000° C. or less for one hour or more and 24 hours or less. By setting temperature and time within the above range, it becomes easy to increase the ratio of the heavy rare earth elements RH incorporated in the liquid phase. In the diffusion step, the respective components included in the above $H_2$ gas, CO gas or $N_2$ gas, or the oxidizing gas are released.

[Recrystallization Step]

Through the recrystallization step after the diffusion step, the liquid phase, which has not been crystallized through the grain boundary diffusion step among the liquid phases incorporating the heavy rare earth elements RH, is also crystallized and becomes the $R_2T_{14}B$ crystal. The recrystallization step is carried out by such as rapidly cooling at a rate of 50° C./min or more and 500° C./min or less. By the recrystallization step, the liquid phase, existing around the $R_2T_{14}B$ crystals including a large amount of the heavy rare earth elements RH and crystallized during the diffusion process, also crystallizes. Further, in the recrystallization step, the $R_2T_{14}B$ crystals including a large amount of the heavy rare earth elements RH start to recrystallize, and the $R_2T_{14}B$ crystals including a small amount of the heavy rare earth elements RH tend to be formed around the $R_2T_{14}B$ crystals including a large amount of the heavy rare earth elements RH. Consequently, the reverse core-shell main phase particles are formed. The cooling rate is not particularly limited, however, it tends to be fine crystals including many amorphous and sub-phases if the cooling rate is excessively fast, while, a boundary surface between the core part 11*a* and the shell part 11*b* of the reverse core-shell main phase particle 11 tend to be unclear if the cooling rate is excessively slow.

As mentioned, it is important that the production method of the R-T-B based sintered magnet of the present embodiment is carried out at least in the order of the decomposition step of decomposing and disproportionating the main phase particles in the magnet surface layer part, the grain boundary diffusion step of forming the liquid phase and diffusing the heavy rare earth elements in the liquid phase, and the recrystallization step of crystallizing the liquid phase around the partially crystallized $R_2T_{14}B$ crystals. This makes it possible to generate the reverse core-shell main phase particles in the magnet surface layer part of the R-T-B based sintered magnet, thereby forming the reverse core-shell particle layer. The methods and conditions of the above decomposition step, the grain boundary diffusion step, and the recrystallization step are merely examples. The decomposition step is sufficient as long as it is a step of decomposing and disproportionating the main phase particles in the magnet surface layer part. The grain boundary diffusion step is sufficient as long as it is a step of forming the liquid phase and diffusing the heavy rare earth elements in the liquid phase. The recrystallization step is sufficient as long as it is a step of generating the reverse core-shell main phase particles and forming the reverse core-shell particle layer.

In the main phase particles not decomposed and disproportionated during the decomposition step, the shell part is formed by the grain boundary diffused heavy rare earth elements RH during the grain boundary diffusion step. The main phase particles become general core-shell main phase particles. Thus, the core-shell particle layer is formed.

[Re-Aging Step]

Re-aging step is performed by heating the sintered magnet after the recrystallization step at a temperature lower than the maximum temperature of the diffusion step. Temperature and time of the re-aging is not particularly limited, however, it can be carried out such as at 450° C. or more and 800° C. or less for 0.2 hour or more and three hours or less.

The R-T-B based sintered magnet obtained by the above steps may be subjected to a surface treatment such as plating, resin coating, oxidation treatment, chemical conversion treatment, etc. As a result, the corrosion resistance can be further improved.

Further, a magnet obtained by cutting and dividing the R-T-B based sintered magnet of the present embodiment can be used.

Specifically, the R-T-B based sintered magnet of the present embodiment is suitably used for applications such as a motor, a compressor, a magnetic sensor, a speaker, etc.

In addition, the R-T-B based sintered magnet of the present embodiment may be used singly, or two or more magnets connected as necessary may be used. The connecting method is not particularly limited. For example, there are methods such as mechanically connected, connected by a resin mold, etc.

By connecting two or more R-T-B based sintered magnets, a large R-T-B based sintered magnet can be easily produced. Magnets in which two or more R-T-B based sintered magnets are connected are preferably used for applications requiring particularly large R-T-B based sintered magnets, such as IPM motors, wind power generators, large motors, etc.

It is to be noted that the present invention is not limited to the mode in which the core-shell particle layer 1*b* and the reverse core-shell particle layer 1*a* are arranged in this order from the magnet central part toward the magnet surface layer part. Various modifications can be made within the scope of the invention.

Figure 1B:
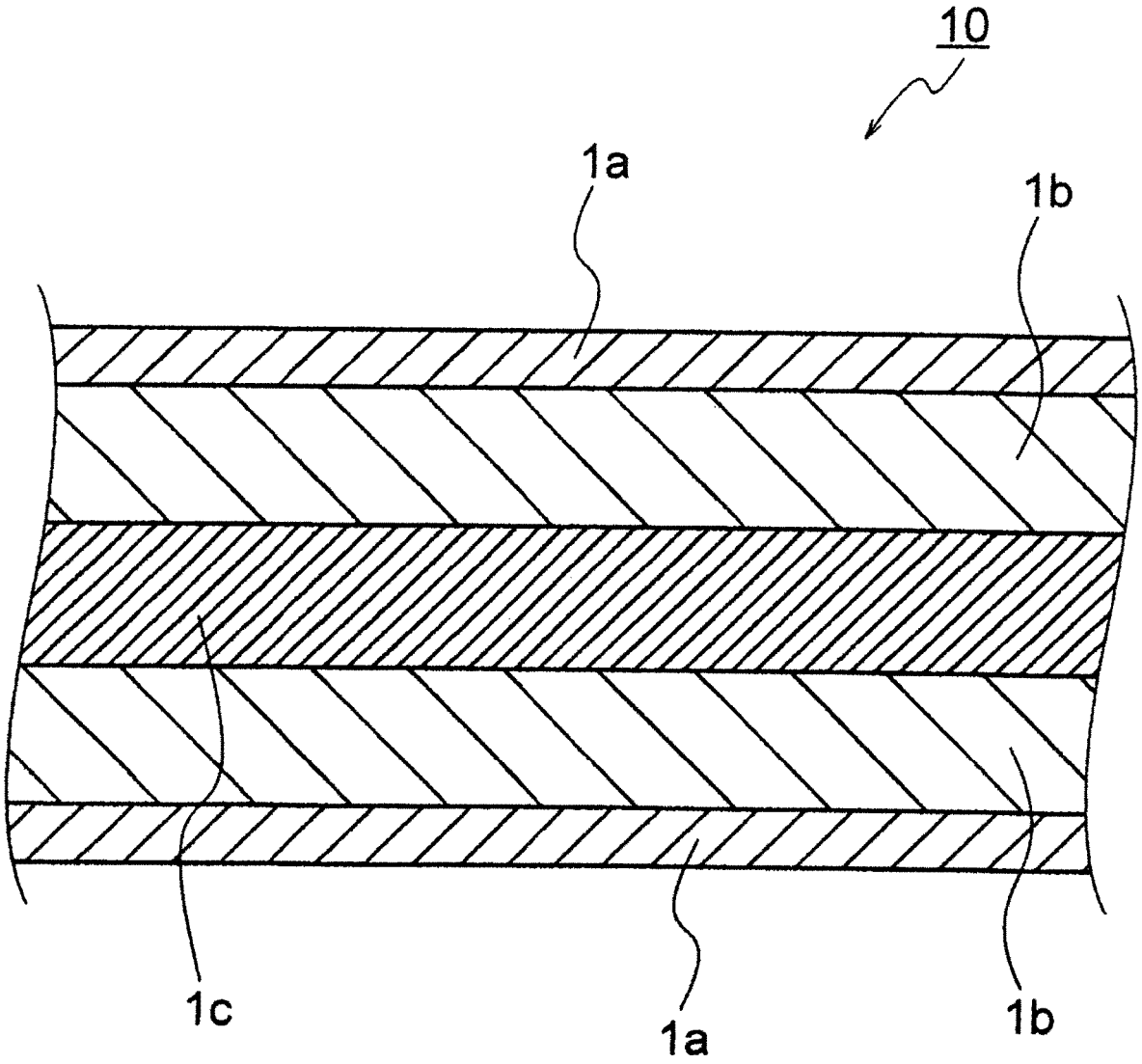
FIG. 1B is a schematic cross-sectional view of an R-T-B based sintered magnet according to an embodiment of the present invention.

For example, as shown in FIG. 1B, an embodiment of the R-T-B based sintered magnet 10, in which a non-core-shell particle layer 1*c*, only including non-core-shell main phase particles not having the core-shell structure, in addition to a core-shell particle layer 1*b* exist in the magnet central part, can be considered. The non-core-shell particle layer 1*c*, the core-shell particle layer 1*b*, and the reverse core-shell particle layer 1*a* may be arranged in this order from the magnet central part toward the magnet surface layer part. Further, the magnet may only include the reverse core-shell particle layer 1*a*, the core-shell particle layer 1*b* and the non-core-shell particle layer 1*c*. It is to be noted that "the main phase particles do not have a core-shell structure" can be confirmed by not observing the core-shell structure when observed with SEM at a magnification of 1000 or more to 10000 or less times.

In the case where the non-core-shell particle layer 1*c* is present (FIG. 1B), the residual magnetic flux density Br tends to be higher than in the case where the non-core-shell particle layer 1*c* does not exist (FIG. 1A).

There is also no particular limitation on the method of causing the non-core-shell particle layer 1*c* to be present. For example, there are a method of adjusting the adhesion amount of the heavy rare earth elements in the grain boundary diffusion step, a method of shortening the diffusion time in the grain boundary diffusion step, etc.

EXAMPLE

Hereinafter, the invention will be described in detail referring to examples; however, the invention is not limited thereto.

(Production Step of Sintered Magnet)

Nd, electrolytic iron, low carbon ferroboron alloy were prepared as raw material metals. Furthermore, Al, Cu, Co and Zr were prepared in a form of a pure metal or an alloy with Fe.

An alloy for the sintered body (a raw material alloy) was produced from the raw material metal by the strip casting method so that the composition of the sintered magnet becomes the composition shown in the column of alloy A in the latter described Table 1. The content (wt %) of each element shown in Table 1 is a value when the total content of Nd, B, Al, Cu, Co, Zr and Fe is taken as 100 wt %. In addition, the alloy thickness of the material alloy is set to 0.2 mm or more and 0.6 mm or less.

Subsequently, hydrogen was stored to the raw material alloy by hydrogen gas flow at room temperature for one hour. Then, the atmosphere was changed to Ar gas, dehydrogenation was carried out at 450° C. for one hour, and the raw material alloy was hydrogen pulverized. Further, after cooling, a powder having a grain size of 400 μm or less was obtained by using a sieve.

Then, oleic acid amide in an amount of 0.1 wt % was added as a pulverization aid to the powder of the raw material alloy after hydrogen pulverization, and mixed thereof.

Next, using a collision plate type jet mill device, a fine pulverization was carried out in a nitrogen stream to obtain a fine powder (a raw material powder) each having an average grain diameter of approximately 4 μm. The average grain diameter is the average grain diameter D50 measured by a laser diffraction type grain diameter distribution meter.

According to the elements not listed in Table 1, H, Si, Ca, La, Ce, Cr, etc. may be detected in some cases. Si is mainly mixed from a ferroboron raw material and crucible at melting of alloy. Ca, La and Ce are mixed from the rare earth raw material. Also, there is a possibility that Cr is mixed from an electrolytic iron.

The obtained fine powder was pressed in a magnetic field to produce a green compact. The applied magnetic field at this time was a static magnetic field of 1200 kA/m. The pressure applied when pressing was 120 MPa. In addition, the magnetic field application direction and the pressing direction were orthogonalized. When density of the green compact was measured at this point, the densities of all the green compacts were within the range of 4.10 $Mg/m^3$ or more and 4.25 $Mg/m^3$ or less.

Next, the green compact was sintered to obtain a sintered magnet. The sintering conditions were maintained at 1060° C. for four hours. The sintering atmosphere was vacuum. The sintered density at the time was in the range of 7.50 $Mg/m^3$ or more and 7.55 $Mg/m^3$ or less. Thereafter, a first aging was carried out for one hour at a first aging temperature T1=900° C. in an Ar atmosphere under an atmospheric pressure, and further a second aging was carried out for one hour at a second aging temperature T2=500° C.

The composition of the obtained sintered magnet was evaluated by fluorescent X-ray analysis. B content was evaluated by ICP. It was confirmed that the composition of the sintered magnet in each sample is as shown in Table 2. Then, the obtained sintered magnets were subjected to the processes of Examples 1 to 22 and Comparative Examples 1 to 6 described hereinafter.

Example 1

The sintered magnet obtained by the above process was processed into a rectangular parallelepiped having a width of 20 mm, a length of 20 mm, and a thickness in the orientation direction of 5 mm, and was then immersed in an atmosphere gas of 5 vol % of hydrogen and 95 vol % of Ar, and held at 750° C. for 10 minutes to decompose and disproportionate the main phase particles mainly existing in the magnet surface layer part.

Next, a slurry in which $TbH_2$ particles (average grain diameter D50=5 μm) are dispersed in ethanol was applied to the entire surface of the sintered magnet so that the weight of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then grain boundary diffused.

After the heat treatment, it was rapidly cooled at a cooling rate of 200° C./min., and the $R_2T_{14}B$ type crystal structures were recrystallized from the liquid phase.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 2

The sintered magnet obtained by the above steps was held at 700° C. for 10 minutes in an atmospheric gas having 8 vol % of CO and 92 vol % of Ar to decompose and disproportionate the main phase particles mainly present in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then grain boundary diffused.

After the heat treatment, it was rapidly cooled at a cooling rate of 200° C./min., and the $R_2T_{14}B$ type crystal structures were recrystallized from the liquid phase Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 3

The sintered magnet obtained by the above steps was held at 650° C. for 30 minutes in an atmospheric gas having 8 vol % of $N_2$ and 92 vol % of Ar to decompose and disproportionate the main phase particles mainly present in the magnet surface layer part.

Next, a slurry in which $ThH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then grain boundary diffused.

After the heat treatment, it was rapidly cooled at a cooling rate of 200° C./min., and the $R_2T_{14}B$ type crystal structures were recrystallized from the liquid phase.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 4

The sintered magnet obtained by the above steps was held at 400° C. for 30 minutes in an oxidizing atmosphere including a gas whose vapor partial pressure was adjusted to 200 hPa, to decompose and disproportionate the main phase particles existing in the magnet surface layer part.

Next, a slurry in which $TbH_2$ particles (average grain diameter D50=5 μm) are dispersed in ethanol was applied to the entire surface of the sintered magnet so that the weight ratio of Tb with respect to that of the sintered magnet became 0.5 wt %. Tb was then adhered to the sintered magnet. After coating the slurry, the heat treatment was carried out at 770° C. for five hours in Ar flow at atmospheric pressure, followed by the heat treatment at 950° C. for five hours. Tb was then grain boundary diffused.

After the heat treatment, it was rapidly cooled at a cooling rate of 200° C./min., and the $R_2T_{14}B$ type crystal structures were recrystallized from the liquid phase.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Example 5

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=80:20. Tb and Nd were adhered making the weight ratio of Tb with respect to the weight of the sintered magnet to 0.5 wt.

Example 6

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=70:30. Tb and Nd were adhered making the weight ratio of Tb with respect to the weight of the sintered magnet to 0.5 wt %.

Example 7

The steps were carried out in the same manner as in Example 1 except that the holding time in an atmosphere gas having 5 vol % of hydrogen and 95 vol % of Ar for 20 minutes.

Example 8

The steps were carried out in the same manner as in Example 1 except that the holding time in an atmosphere gas having 5 vol % of hydrogen and 95 vol % of Ar for 30 minutes.

Example 9

The steps were carried out in the same manner as in Example 1 except that the cooling rate after the heat treatment was set to 50° C./min.

Example 10

The steps were carried out in the same manner as in Example 1 except that the cooling rate after the heat treatment was set to 500° C./min.

Example 11

The steps were carried out in the same manner as in Example 1 except that the $TbH_2$ particles (average grain diameter D50=5 μm) were replaced with the particles in which $TbH_2$ particles (average grain diameter D50=5 μm) and $NdH_2$ particles (average grain diameter D50=5 μm) are mixed to be Tb:Nd=30:70. Tb and Nd were adhered making the weight ratio of Tb with respect to the weight of the sintered magnet to 0.5 wt %.

Example 12

The steps were carried out in the same manner as in Example 1 except that the $TbH_2$ particles (average grain diameter D50=5 μm) were replaced with the particles in which $TbH_2$ particles (average grain diameter D 50=5 μm) and $NdH_2$ particles (average grain diameter D50=5 μm) are mixed to be Tb:Nd=50:50. Tb and Nd were adhered making the weight ratio of Tb with respect to the weight of the sintered magnet to 0.5 wt %.

Example 13

The steps were carried out in the same manner as in Example 2 except that the holding temperature in an atmosphere gas having 8 vol % of CO and 92 vol % of Ar was 600° C.

Example 14

The steps were carried out in the same manner as in Example 1 except that Tb was grain boundary diffused by carrying out the heat treatment only once at 950° C. for 10 hours in Ar flow at atmospheric pressure, after applying slurry.

Example 15

The steps were carried out in the same manner as in Example 1 except that the $TbF_2$ particles (average grain diameter D50=5 μm) were replaced with the $TbF_3$ particles (average grain diameter D50=5 μm). Tb was adhered making the weight ratio of Tb with respect to the weight of the sintered magnet to 0.5 wt %.

Example 16

The steps were carried out in the same manner as in Example 1 except that the $TbH_2$ particles (average grain diameter D50=5 μm) were replaced with the $Tb_2O_3$ particles (average grain diameter D50=5 μm). Tb was adhered making the weight ratio of Tb with respect to the weight of the sintered magnet to 0.5 wt %.

Example 17

The steps were carried out in the same manner as in Example 1 except that the $TbH_2$ particles (average grain diameter D50=5 μm) were replaced with the Tb—Fe compound [Tb:Fe=80:20 (atomic ratio)] (average grain diameter D50=5 μm). Tb was adhered making the weight ratio of Tb with respect to the weight of the sintered magnet to 0.5 wt %.

Example 18

The steps were carried out in the same manner as in Example 1 except that the $TbH_2$ particles (average grain diameter D50=5 μm) were replaced with the $DyH_2$ particles (average grain diameter D50=5 μm). Dy was adhered making the weight ratio of Dy with respect to the weight of the sintered magnet to 0.5 wt %.

Example 19

The steps were carried out in the same manner as in Example 1 except that the $TbH_2$ particles (average grain diameter D50=5 μm) were replaced with the $DyF_3$ particles (average grain diameter D50=5 μm). Dy was adhered making the weight ratio of Dy with respect to the weight of the sintered magnet to 0.5 wt %.

Example 20

The steps were carried out in the same manner as in Example 1 except that the $TbH_2$ particles (average grain diameter D50=5 μm) were replaced with the Dy—Fe compound [Dy:Fe=80:20 (atomic ratio)] (average grain diameter D50=5 μm). Dy was adhered making the weight ratio of Dy with respect to the weight of the sintered magnet to 0.5 wt %.

Example 21

Example 21 was carried out in the same manner as in Example 1 except that the composition of the sintered magnet before grain boundary diffusion was set to the composition shown in Table 1. Specifically, the raw material alloy G was produced. Then, similar to Example 1, pulverization, pressing, sintering and aging were carried out to obtain the sintered magnet having the composition shown in Table 2. Then, in the same manner as in Example 1, the main phase particles in the magnet surface layer part were decomposed and disproportionated, and Tb diffusion treatment was performed. Then, recrystallization and re-aging were carried out in the same manner as in Example 1. For the sintered magnet after the re-aging, the magnetic properties of residual magnetic flux density Br, coercive force Hcj and squareness ratio Hk/Hcj were evaluated with B-H tracer.

Example 22

Example 22 was carried out in the same manner as in Example 1 except that the composition of the sintered magnet before grain boundary diffusion was set to the composition shown in Table 1. Specifically, the raw material alloy H was produced. Then, similar to Example 1, pulverization, pressing, sintering and aging were carried out to obtain the sintered magnet having the composition shown in Table 2. Then, in the same manner as in Example 1, the main phase particles in the magnet surface layer part were decomposed and disproportionated, and Tb diffusion treatment was performed. Then, recrystallization and re-aging were carried out in the same manner as in Example 1. For the sintered magnet after the re-aging, the magnetic properties of residual magnetic flux density Br, coercive force Hcj and squareness ratio Hk/Hcj were evaluated with B-H tracer.

Comparative Example 1

Next, a slurry in which $TbH_2$ particles (average grain diameter D50=5 μm) are dispersed in ethanol was applied to the entire surface of the sintered magnet obtained by the above sintered magnet manufacturing process, making the weight of Tb with respect to the weight of the sintered magnet to 0.5 wt %. Tb was then adhered. After coating the slurry, the heat treatment was carried out at 770° C. for five hours in Ar flow at atmospheric pressure, followed by the heat treatment at 950° C. for five hours. Tb was then grain boundary diffused. After the heat treatment, it was rapidly cooled at a cooling rate of 200° C./min.

Thereafter, the re-aging was carried out at 500° C. for one hour in Ar atmosphere at atmospheric pressure.

For the sintered magnet after the re-aging, the magnetic properties of residual magnetic flux density Br, coercive force Hcj and squareness ratio Hk/Hcj were evaluated with B-H tracer.

Comparative Example 2

In the production steps of the sintered magnet according to Comparative Example 2, the alloys for sintered bodies (raw material alloys) B and C were produced so as to have the composition shown in Table 1. The raw material alloy B and the raw material alloy C shown in Table 1 were hydrogen-pulverized, and then mixed to have the weight ratio of 9:1. Then, fine pulverization, pressing, sintering and aging were carried out in the same manner as in Example 1 to obtain a sintered magnet having the composition shown in Table 2. It was confirmed that the composition of the sintered magnet was the same as that of the sintered magnets of Examples 1 to 4, 7 to 10 and Comparative Example 1 after the diffusion.

For the sintered magnet after the aging, the magnetic properties of residual magnetic flux density Br, coercive force Hcj and squareness ratio Hk/Hcj were evaluated with B-H tracer.

Comparative Example 3

In Comparative Example 3, the sintered body alloys (raw material alloys) D and E were produced by the strip casting method so as to have the composition shown in Table 2 described below. The raw material alloy D and the raw material alloy E shown in Table 2 were hydrogen-pulverized, and then mixed to have the weight ratio of 9:1. Thereafter, fine pulverization, pressing, sintering and aging were carried out in the same manner as in Example 1 to obtain the sintered magnet having the composition shown in Table 2.

For the sintered magnet after the aging, the magnetic properties of residual magnetic flux density Br, coercive force Hcj and squareness ratio Hk/Hcj were evaluated with B-H tracer.

Comparative Example 4

In Comparative Example 4, the alloy for the sintered body (raw material alloy) was produced in the same manner as in Example 1 except that the composition of the finally obtained sintered magnet was the composition shown in Table 1. Specifically, raw material alloy F was produced. Then, pulverization, pressing, sintering and aging were carried out to in the same manner as in Example 1 to obtain the sintered magnet having the composition shown in Table 2.

For the sintered magnet after the aging, the magnetic properties of residual magnetic flux density Br, coercive force Hcj and squareness ratio Hk/Hcj were evaluated with B-H tracer.

Comparative Example 5

The steps were carried out in the same manner as in Example 1 except that the cooling rate in the recrystallization step after the diffusion was set to 10° C./min.

Comparative Example 6

In Comparative Example 6, the slurry in which $DyH_2$ particles (average grain diameter D50=5 μm) are dispersed in ethanol was applied to the entire surface of the sintered magnet, which was obtained so that the composition of the sintered magnet before the grain boundary diffusion had the composition shown in Table 1. Thus, the weight ratio of Dy with respect to that of the sintered magnet became 1.0 wt %. Dy was then adhered to the sintered magnet. After coating the slurry, the heat treatment was carried out at 770° C. for five hours in Ar flow at atmospheric pressure, followed by the heat treatment at 950° C. for five hours. Dy was then grain boundary diffused after the heat treatment, it was rapidly cooled at a cooling rate of 200° C./min. Then, the re-aging was carried out at 500° C. for one hour in Ar atmosphere at an atmospheric pressure. The magnetic properties of residual magnetic flux density Br, coercive force Hcj and squareness ratio Hk/Hcj of the sintered magnet after the re-aging were evaluated with B-H tracer.

Table 3 shows whether the decomposition for decomposing the main phase particles present in the surface layer part of the sintered magnet, grain boundary diffusion, and rapid cooling after the grain boundary diffusion were carried out. "Done" is given when each process was performed, "Not Done" is given when each process was not performed.

Table 3 shows the evaluation results of the magnetic properties of residual magnetic flux density Br, coercive force Hcj and squareness ratio Hk/Hcj with respect to the R-T-B based sintered magnets of the respective Examples and Comparative Examples with B-H tracer. The residual magnetic flux density Br of 1380 mT or more was defined preferable, and 1400 mT or more was defined further preferable. The coercive force Hcj was defined preferable when 1800 kA/m or more, and more preferable when 1830 kA/m or more, when Tb was grain boundary diffused. The coercive force Hcj was defined preferable when 1600 kA/m or more, and more preferable when 1620 kA/m or more, when Dy was grain boundary diffused. When the squareness ratio Hk/Hcj exceeds 0.90, it is regarded as preferable, and the case when it is 0.95 or more is regarded more preferable.

In addition, the R-T-B based sintered magnets of each Example and Comparative Example were cut at an arbitrary cross section and the cross section was observed. Existence ratio of the reverse core-shell main phase particles in a region of 20 μm from the surface of the magnet toward the inside of the magnet in the magnet surface layer part was measured. The measurement of the existence ratio of the reverse core-shell main phase particles in the magnet surface layer part was carried out with respect to 10 main phase particles randomly selected from the main phase particles in the part of 20 μm from the magnet surface toward the inside of the magnet, using SEM and TEM-EDS. Also, the existence ratio of the reverse core-shell main phase particles in the magnet central part was measured. Measurement of the existence ratio of the reverse core-shell main phase particles in the magnet central part was carried out by using SEM and TEM-EDS for 10 main phase particles randomly selected from the main phase particles in the magnet central part. The results are shown in Table 4.

Further, with respect to the reverse core-shell main phase particles present in the magnet surface layer part in each example, the total RH concentration $C_{RC}$ in the core part and the total RH concentration $C_{RS}$ in the shell part were measured. The ratio of particles having $C_{RC}/C_{RS}>1.5$ and the same having $C_{RC}/C_{RS}>3.0$ in each reverse core-shell main phase particles were calculated using TEM-EDS. The results are shown in Table 4.

According to the reverse core-shell main phase particles 11 of this example, the measurement points of the total RH concentration in the core part 11*a* and the same in the shell part 11*b* are as follows.

First, the reverse core-shell main phase particles 11 for measuring the concentration was observed with transmission electron microscope (TEM), and the diameter having the maximum length was specified. Next, two intersection points of the diameter and the grain boundary were specified. Then, the total RH concentration in a region of 20 nm×20 nm centered on a midpoint of the two intersection points were measured, and defined as the total RH concentration $C_{RC}$ in the core part.

Next, one of the two intersection points was selected. Then, the total RH concentration in a region of 20 nm×20 nm centered at the point, penetrating the reverse core-shell main phase particle side and 20 nm apart from the intersection point along the diameter having the maximum length, was measured.

The existence ratio of the core-shell main phase particles in the magnet surface layer part was measured with respect to 10 main phase particles randomly selected from the main phase particles in the part of 20 μm from the magnet surface toward the inside of the magnet in the magnet surface layer part, using SEM and TEM-EDS. Also, the existence ratio of the core-shell particles in the magnet central part was measured. Measurement of the existence ratio of the core-shell main phase particles in the magnet central part was carried out to 10 main phase particles randomly selected from the main phase particles in the magnet central part by using SEM and TEM-EDS. The results are shown in Table 4.

Furthermore, with respect to each example, the thickness of the reverse core-shell particle layer, the thickness of the core-shell particle layer, and the thickness of the non-core-shell particle layer were respectively measured using SEM. The results are shown in Table 4. The thickness of each layer is the thickness per a layer. When two or more layers of the each layer were present, the average was calculated and was taken as the thickness per a layer of the each layer.

Hereinafter, the measuring method of the thickness of each layer will be described in more detail. The R-T-B based sintered magnets of each Example and Comparative Example were cut along a cross section parallel to the orientation direction. The cross section was mirror polished and then observed with an electron microscope (SEM) at a magnification of 1,000. SEM observation was carried out continuously along the orientation direction from the magnet surface to the opposite magnet surface. The region from the point where the reverse core-shell particles were observed until it was no longer observed in the observation field was referred to as the reverse core-shell particle layer mainly including the reverse core-shell main phase particles. Then, the thickness of the reverse core-shell particle layer was estimated from the SEM image. Also, the region from the point where the reverse core-shell particles were no longer observed until the core-shell particles were not observed in the observation field was referred to as the core-shell particle layer mainly including the core-shell main phase particles. Then, the thickness of the core-shell particle layer was estimated. Further, in the observation field, the region in which the reverse core-shell particles and the core-shell particles were not observed is defined as the non-core-shell particle layer including the non-core-shell main phase particles. Then, the thickness of the non-core-shell particle layer was estimated.

TABLE 1

| Composition of Raw Material Alloy | Nd | Al | Co | Cu | Zr | B | Tb | Fe |
|---|---|---|---|---|---|---|---|---|
| | | | | | wt. % | | | |
| Alloy A (Exs. 1 to 20, Comp. Exs. 1, 5, 6) | 30.5 | 0.2 | 0.5 | 0.1 | 0.15 | 1.01 | 0.0 | Bal. |
| Alloy B (Comp. Ex. 2) | 31.0 | 0.2 | 0.0 | 0.0 | 0.17 | 1.11 | 0.0 | Bal. |
| Alloy C (Comp. Ex. 2) | 24.0 | 0.0 | 5.0 | 1.0 | 0.00 | 0.00 | 5.0 | Bal. |
| Alloy D (Comp. Ex. 3) | 31.0 | 0.2 | 0.0 | 0.0 | 0.17 | 1.10 | 0.0 | Bal. |
| Alloy E (Comp. Ex. 3) | 20.0 | 0.0 | 5.0 | 1.0 | 0.00 | 0.00 | 21.0 | Bal. |

TABLE 1-continued

| Composition of Raw Material Alloy | Nd | Al | Co | Cu | Zr | B | Tb | Fe |
|---|---|---|---|---|---|---|---|---|
| | | | | | wt. % | | | |
| Alloy F (Comp. Ex. 4) | 29.4 | 0.2 | 0.5 | 0.1 | 0.14 | 0.97 | 3.5 | Bal. |
| Alloy G (Ex. 21) | 29.0 | 0.2 | 0.5 | 0.1 | 0.15 | 1.00 | 0.0 | Bal. |
| Alloy H (Ex. 22) | 32.0 | 0.2 | 0.5 | 0.1 | 0.15 | 1.00 | 0.0 | Bal. |

TABLE 2

| Composition of the sintered magnet before the grain boundary diffusion | Nd | Al | Co | Cu | Zr | B | Tb | Fe |
|---|---|---|---|---|---|---|---|---|
| | | | | | wt. % | | | |
| Exs. 1 to 20, Comp. Exs. 1, 5, 6 | 30.5 | 0.2 | 0.5 | 0.1 | 0.15 | 1.01 | 0.0 | Bal. |
| Comp. Ex. 2 | 30.3 | 0.2 | 0.5 | 0.1 | 0.15 | 1.00 | 0.5 | Bal. |
| Comp. Ex. 3 | 29.9 | 0.2 | 0.5 | 0.1 | 0.15 | 0.99 | 2.1 | Bal. |
| Comp. Ex. 4 | 29.4 | 0.2 | 0.5 | 0.1 | 0.14 | 0.97 | 3.5 | Bal. |
| Ex. 21 | 29.0 | 0.2 | 0.5 | 0.1 | 0.15 | 1.00 | 0.0 | Bal. |
| Ex. 22 | 32.0 | 0.2 | 0.5 | 0.1 | 0.15 | 1.00 | 0.0 | Bal. |

TABLE 3

| | Grain Boundary Diffused Element | Decomposition | Grain Boundary Diffusion | Rapid Cooling | Residual Magnetic Flux Density Br (mT) | Coercive Force Hcj (kA/m) | Squareness Ratio Hk/Hcj |
|---|---|---|---|---|---|---|---|
| Ex. 1 | Tb | ○ | ○ | ○ | 1420 | 1850 | 0.97 |
| Ex. 2 | Tb | ○ | ○ | ○ | 1420 | 1840 | 0.96 |
| Ex. 3 | Tb | ○ | ○ | ○ | 1420 | 1830 | 0.95 |
| Ex. 4 | Tb | ○ | ○ | ○ | 1420 | 1840 | 0.96 |
| Ex. 5 | Tb | ○ | ○ | ○ | 1420 | 1830 | 0.95 |
| Ex. 6 | Tb | ○ | ○ | ○ | 1420 | 1810 | 0.95 |
| Ex. 7 | Tb | ○ | ○ | ○ | 1400 | 1850 | 0.96 |
| Ex. 8 | Tb | ○ | ○ | ○ | 1380 | 1840 | 0.96 |
| Ex. 9 | Tb | ○ | ○ | ○ | 1400 | 1810 | 0.95 |
| Ex. 10 | Tb | ○ | ○ | ○ | 1400 | 1830 | 0.98 |
| Ex. 11 | Tb | ○ | ○ | ○ | 1380 | 1800 | 0.94 |
| Ex. 12 | Tb | ○ | ○ | ○ | 1410 | 1800 | 0.95 |
| Ex. 13 | Tb | ○ | ○ | ○ | 1420 | 1820 | 0.95 |
| Ex. 14 | Tb | ○ | ○ | ○ | 1420 | 1830 | 0.96 |
| Ex. 15 | Tb | ○ | ○ | ○ | 1410 | 1840 | 0.96 |
| Ex. 16 | Tb | ○ | ○ | ○ | 1410 | 1830 | 0.95 |
| Ex. 17 | Tb | ○ | ○ | ○ | 1420 | 1850 | 0.95 |
| Ex. 21 | Tb | ○ | ○ | ○ | 1430 | 1840 | 0.95 |
| Ex. 22 | Tb | ○ | ○ | ○ | 1400 | 1840 | 0.95 |
| Comp. Ex. 1 | Tb | X | ○ | ○ | 1420 | 1770 | 0.90 |
| Comp. Ex. 2 | Tb | X | X | X | 1370 | 1290 | 0.91 |
| Comp. Ex. 3 | Tb | X | X | X | 1330 | 1850 | 0.91 |
| Comp. Ex. 4 | Tb | X | X | X | 1280 | 1850 | 0.92 |
| Comp. Ex. 5 | Tb | ○ | ○ | X | 1420 | 1790 | 0.90 |
| EX. 18 | Dy | ○ | ○ | ○ | 1400 | 1630 | 0.96 |
| EX. 19 | Dy | ○ | ○ | ○ | 1400 | 1630 | 0.96 |
| Ex. 20 | Dy | ○ | ○ | ○ | 1390 | 1640 | 0.95 |
| Comp. Ex. 6 | Dy | X | ○ | ○ | 1400 | 1550 | 0.90 |

TABLE 4

| | Existence ratio of the reverse core shell particles in the magnet surface layer part | Existence ratio of the reverse core shell particles in the magnet central part | Ratio (%) of the reverse core shell particles satisfying $C_{RC}/C_{RS}$ >1.5 | Ratio (%) of the reverse core shell particles satisfying $C_{RC}/C_{RS}$ >3.0 | Existence ratio of the core shell particles in the magnet surface layer part |
|---|---|---|---|---|---|
| Ex. 1 | 10/10 | 0/10 | 100 | 100 | 0/10 |
| Ex. 2 | 8/10 | 0/10 | 100 | 100 | 0/10 |
| Ex. 3 | 7/10 | 0/10 | 100 | 100 | 0/10 |
| Ex. 4 | 8/10 | 0/10 | 100 | 100 | 0/10 |
| Ex. 5 | 7/10 | 0/10 | 100 | 86 | 0/10 |
| Ex. 6 | 6/10 | 0/10 | 83 | 67 | 0/10 |

TABLE 4-continued

| | | | | | |
|---|---|---|---|---|---|
| Ex. 7 | 10/10 | 0/10 | 100 | 100 | 0/10 |
| Ex. 8 | 10/10 | 0/10 | 90 | 80 | 0/10 |
| Ex. 9 | 7/10 | 0/10 | 86 | 71 | 0/10 |
| Ex. 10 | 8/10 | 0/10 | 88 | 75 | 0/10 |
| Ex. 11 | 2/10 | 0/10 | 0 | 0 | 3/10 |
| Ex. 12 | 2/10 | 0/10 | 50 | 0 | 0/10 |
| Ex. 13 | 5/10 | 0/10 | 67 | 67 | 0/10 |
| Ex. 14 | 9/10 | 0/10 | 89 | 89 | 0/10 |
| Ex. 15 | 10/10 | 0/10 | 100 | 100 | 0/10 |
| Ex. 16 | 9/10 | 0/10 | 100 | 100 | 0/10 |
| Ex. 17 | 8/10 | 0/10 | 88 | 88 | 0/10 |
| Ex. 21 | 9/10 | 0/10 | 100 | 100 | 0/10 |
| Ex. 22 | 10/10 | 0/10 | 100 | 100 | 0/10 |
| Comp. Ex. 1 | 0/10 | 0/10 | | | 10/10 |
| Comp. Ex. 2 | 0/10 | 0/10 | | | 3/10 |
| Comp. Ex. 3 | 0/10 | 0/10 | | | 9/10 |
| Comp. Ex. 4 | 0/10 | 0/10 | | | 0/10 |
| Comp. Ex. 5 | 0/10 | 0/10 | | | 0/10 |
| Ex. 18 | 10/10 | 0/10 | 100 | 100 | 0/10 |
| Ex. 19 | 10/10 | 0/10 | 100 | 100 | 0/10 |
| Ex. 20 | 8/10 | 0/10 | 88 | 88 | 0/10 |
| Comp. Ex. 6 | 0/10 | 0/10 | | | 9/10 |

| | Existence ratio of the core shell particles in the magnet central part | Existence ratio of the non-core shell particles in the magnet central part | Thickness of the reverse core shell particle layer (μm) | Thickness of the core shell particle layer (μm) | Thickness of the non-core shell particles (μm) |
|---|---|---|---|---|---|
| Ex. 1 | 1/10 | 9/10 | 30 | 1400 | 2100 |
| Ex. 2 | 0/10 | 10/10 | 30 | 1400 | 2100 |
| Ex. 3 | 0/10 | 10/10 | 20 | 1500 | 2000 |
| Ex. 4 | 0/10 | 10/10 | 30 | 1400 | 2100 |
| Ex. 5 | 2/10 | 8/10 | 20 | 1500 | 2000 |
| Ex. 6 | 2/10 | 8/10 | 10 | 1600 | 1800 |
| Ex. 7 | 1/10 | 9/10 | 60 | 1200 | 2500 |
| Ex. 8 | 0/10 | 10/10 | 200 | 1000 | 2800 |
| Ex. 9 | 0/10 | 10/10 | 30 | 1400 | 2100 |
| Ex. 10 | 0/10 | 10/10 | 30 | 1400 | 2100 |
| Ex. 11 | 3/10 | 7/10 | 10 | 1600 | 1800 |
| Ex. 12 | 3/10 | 7/10 | 10 | 1700 | 1600 |
| Ex. 13 | 1/10 | 9/10 | 20 | 1500 | 2000 |
| Ex. 14 | 0/10 | 10/10 | 50 | 1600 | 1700 |
| Ex. 15 | 0/10 | 10/10 | 30 | 1400 | 2100 |
| Ex. 16 | 0/10 | 10/10 | 30 | 1400 | 2100 |
| Ex. 17 | 2/10 | 8/10 | 20 | 1500 | 2000 |
| Ex. 21 | 0/10 | 10/10 | 30 | 1200 | 2500 |
| Ex. 22 | 2/10 | 8/10 | 30 | 1500 | 2000 |
| Comp. Ex. 1 | 2/10 | 8/10 | | 1400 | 2200 |
| Comp. Ex. 2 | 3/10 | 7/10 | | 0 | 5000 |
| Comp. Ex. 3 | 9/10 | 1/10 | | 5000 | 0 |
| Comp. Ex. 4 | 0/10 | 10/10 | | 0 | 5000 |
| Comp. Ex. 5 | 1/10 | 9/10 | | 1400 | 2200 |
| Ex. 18 | 1/10 | 9/10 | 30 | 1500 | 2000 |
| Ex. 19 | 1/10 | 9/10 | 30 | 1500 | 2000 |
| Ex. 20 | 2/10 | 8/10 | 20 | 1500 | 2000 |
| Comp. Ex. 6 | 1/10 | 9/10 | | 1400 | 2200 |

From Tables 1 to 4, it is shown that the R-T-B based sintered magnets of Examples 1 to 22 which went through the step of decomposing and disproportionating the main phase particles of the magnet surface layer part after sintering, the step of making a liquid phase and incorporating RH into the liquid phase by grain boundary diffusion, the step of recrystallizing the liquid phase in which RH is incorporated by a rapid cooling, formed the reverse core-shell particle layer in which the reverse core-shell main phase particles are generated in the magnet surface layer part. The residual magnetic flux density, the coercive force and the squareness ratio thereof were preferable.

Further, among the examples in which Tb was grain boundary diffused, Examples 1 to 7, 9 to 10, 12 to 17 and 21 to 22, in which the thickness of the reverse core-shell particle layer was 10 μm or more and 60 μm or less and reverse core-shell particles showing $C_{RC}/C_{RS}>1.5$ were present, the residual magnetic flux density was more preferable.

On the other hand, the reverse core-shell main phase particles were not generated in the comparative examples, which did not undergo the step of decomposing and disproportionating the main phase particles of the magnet surface layer part after sintering, the step of making the liquid phase and incorporating RH into the liquid phase by the grain boundary diffusion, the step of recrystallizing the liquid phase in which RH is incorporated by a rapid cooling. As a result, residual magnetic flux density, coercive force and/or squareness ratio of comparative examples were inferior to that of Examples 1 to 22.

In Comparative Examples 1 and 6, since the process of decomposing and disproportionating the main phase particles in the magnet surface layer part after sintering was not carried out, the reverse core-shell main phase particles were not formed even through the grain boundary diffusion and the rapid cooling. In Comparative Example 2, a sintered magnet was produced by the two-alloy method, but no reverse core-shell main phase particles were produced. As a result, residual magnetic flux density and coercive force thereof were inferior to those of Examples 1 to 17 and 21 to 22. In Comparative Examples 3 and 4, as a result of increasing the Tb content, the coercive force was preferable but the residual magnetic flux density was inferior to that of Examples 1 to 17 and 21 to 22. Also, since the Tb content increased, a producing cost of the sintered magnets of Comparative Examples 3 and 4 were more expensive than that of the sintered magnets of Examples 1 to 17 and 21 to 22. In Comparative Example 5, since the cooling rate during the recrystallization step after the diffusion was too slow, it became homogeneous main phase particles and the reverse core-shell main phase particles were not produced.

EXPLANATION OF REFERENCES

1, 10: R-T-B based sintered magnet
- 1*a*: Reverse core-shell particle layer
- 1*b*: Core-shell particle layer
- 1*c*: Non-core-shell particle layer

11: Reverse core-shell main phase particle
- 11*a*: Core part (reverse core-shell main phase particle)
- 11*b*: Shell part (reverse core-shell main phase particle)

12: Grain boundary
13: Core-shell main phase particle
- 13*a*: Core part (core-shell main phase particle)
- 13*b*: Shell part (core-shell main phase particle)

The invention claimed is:

1. An R-T-B based sintered magnet including a plural number of main phase grains comprising an $R_2T_{14}B$ crystal structure, wherein R is at least one rare earth element essentially comprising a heavy rare earth element RH, T is at least one transition metal element essentially comprising Fe or Fe and Co, and B is boron, at least one of the main phase grains is a reverse core-shell main phase grain comprising a shell part and a core part covered by the shell part, and $C_{RC}/C_{RS}>1.5$ is satisfied, where $C_{RC}$ is an RH concentration (at%) in the core part, $C_{RS}$ is an RH concentration (at%) in the shell part, and an existence ratio of the reverse core-shell main phase grains is larger in a surface layer part of the magnet than in a central part of the magnet.

2. The R-T-B based sintered magnet according to claim 1, wherein at least one of the main phase grains is a core-shell main phase grain comprising a shell part and a core part covered by the shell part, and $C_{NC}/C_{NS}<1.0$ is satisfied, where $C_{NC}$ is an RH concentration (at%) in the core part, and $C_{NS}$ is an RH concentration (at%) in the shell part.

3. The R-T-B based sintered magnet according to claim 2, comprising a core-shell grain layer mainly comprising the core-shell main phase grains and a reverse core-shell grain layer mainly comprising the reverse core-shell main phase grains.

4. The R-T-B based sintered magnet according to claim 3, wherein the core-shell grain layer and the reverse core-shell grain layer are arranged in this order from the central part of the magnet toward the surface layer part of the magnet.

5. The R-T-B based sintered magnet according to claim 4, wherein the R-T-B based sintered magnet comprises a non-core-shell grain layer mainly comprising non-core-shell main phase grains having no core-shell structures, and the non-core-shell grain layer, the core-shell grain layer and the reverse core-shell grain layer are arranged in this order from the central part of the magnet toward the surface layer part of the magnet.

6. An R-T-B based sintered magnet including a plural number of main phase grains comprising an $R_2T_{14}B$ crystal structure, wherein R is at least one rare earth element essentially comprising a heavy rare earth element RH, T is at least one transition metal element essentially comprising Fe or Fe and Co, and B is boron, at least one of the main phase grains is a reverse core-shell main phase grain comprising a shell part and a core part covered by the shell part, $C_{RC}/C_{RS}>1.0$ is satisfied, where $C_{RC}$ is an RH concentration (at%) in the core part, $C_{RS}$ is an RH concentration (at%) in the shell part, and an existence ratio of the reverse core-shell main phase grains is larger in a surface layer part of the magnet than in a central part of the magnet, at least one of the main phase grains is a core-shell main phase grain comprising a shell part and a core part covered by the shell part, $C_{NC}C_{NS}<1.0$ is satisfied, where $C_{NC}$ is an RH concentration (at%) in the core part, and $C_{NS}$ is an RH concentration (at%) in the shell part, and the R-T-B based sintered magnet comprises a core-shell grain layer mainly comprising the core-shell main phase grains and a reverse core-shell grain layer mainly comprising the reverse core-shell main phase grains.

7. The R-T-B based sintered magnet according to claim 6, wherein $C_{RC}/C_{RS}>1.5$ is satisfied.

8. The R-T-B based sintered magnet according to claim 6, wherein the core-shell grain layer and the reverse core-shell grain layer are arranged in this order from the central part of the magnet toward the surface layer part of the magnet.

9. The R-T-B based sintered magnet according to claim 7, wherein the core-shell grain layer and the reverse core-shell grain layer are arranged in this order from the central part of the magnet toward the surface layer part of the magnet.

10. The R-T-B based sintered magnet according to claim 8, wherein the R-T-B based sintered magnet comprises a non-core-shell grain layer mainly comprising non-core-shell main phase grains having no core-shell structures, and the non-core-shell grain layer, the core-shell grain layer and the reverse core-shell grain layer are arranged in this order from the central part of the magnet toward the surface layer part of the magnet.

11. The R-T-B based sintered magnet according to claim 9, wherein the R-T-B based sintered magnet comprises a non-core-shell grain layer mainly comprising non-core-shell main phase grains having no core-shell structures, and the non-core-shell grain layer, the core-shell grain layer and the reverse core-shell grain layer are arranged in this order from the central part of the magnet toward the surface layer part of the magnet.

* * * * *